US012612201B1

(12) United States Patent
Bison et al.

(10) Patent No.: US 12,612,201 B1
(45) Date of Patent: Apr. 28, 2026

(54) PRE-PERFORATED STRETCH FILM WRAPPING SYSTEM AND METHOD

(71) Applicant: Allied Packaging Corporation, Phoenix, AZ (US)

(72) Inventors: Darrel Bison, Phoenix, AZ (US); Steven D. Smith, Phoenix, AZ (US)

(73) Assignee: Allied Packaging Corporation, Phoenix, AZ (US)

( * ) Notice: Subject to any disclaimer, the term of this patent is extended or adjusted under 35 U.S.C. 154(b) by 0 days.

(21) Appl. No.: 18/926,038

(22) Filed: Oct. 24, 2024

(51) Int. Cl.

| | |
|---|---|
| ***B65B 41/16*** | (2006.01) |
| ***B65B 11/02*** | (2006.01) |
| ***B65B 11/04*** | (2006.01) |
| ***B65B 11/58*** | (2006.01) |
| *B65B 11/00* | (2006.01) |

(52) U.S. Cl.
CPC ..... *B65B 11/585* (2013.01); *B65B 11/045* (2013.01); *B65B 41/16* (2013.01); *B65B 2011/002* (2013.01)

(58) Field of Classification Search
CPC ..... B65B 11/585; B65B 11/045; B65B 41/16; B65B 2011/002; B65B 11/58; B65B 11/04; B65B 11/02
USPC ..... 53/441, 589, 588, 587, 556, 176, 170, 53/465, 449, 399
See application file for complete search history.

(56) References Cited

U.S. PATENT DOCUMENTS

| | | | |
|---|---|---|---|
| 1,109,461 | A | 9/1914 | Price |
| 1,351,809 | A | 9/1920 | Sutherland |
| 2,026,282 | A | 12/1935 | Leguillon |
| 2,823,530 | A | 2/1958 | Rikard |
| 3,019,573 | A | 2/1962 | Navikas |
| 3,227,854 | A | 1/1966 | Ramsey |
| 3,793,798 | A | 2/1974 | Lancaster |
| 3,896,604 | A | 7/1975 | Marantz |
| 4,079,633 | A | 3/1978 | Cheema |

(Continued)

FOREIGN PATENT DOCUMENTS

| | | |
|---|---|---|
| CL | 199600979 | 3/1997 |
| CL | 199602233 | 9/1997 |

(Continued)

OTHER PUBLICATIONS

USPTO translation of JP 2-45309 A, Aug. 13, 2013, 7 pages.

(Continued)

*Primary Examiner* — Praachi M Pathak
(74) *Attorney, Agent, or Firm* — Kenneth C. Booth; Booth Udall, PLC

(57) ABSTRACT

A method for wrapping a palletized load. A first spool with first, second, and third rolls of stretch film and a second spool with a roll of perforated stretch film may be provided. A top edge and bottom edge of the stretch film from the first, second, and third rolls of stretch film may be banded. The first, second, and third banded stretch films may be layered onto the perforated stretch film to form a layered stretch film. The first banded stretch film may extend along a top edge, the second banded stretch film may extend along a center, and the third banded stretch film may extend along a bottom edge of the perforated stretch film. The perforations in the layered stretch film may be expanded into a plurality of voids. The layered stretch film may then be wrapped around the palletized load.

20 Claims, 4 Drawing Sheets

(56) References Cited

U.S. PATENT DOCUMENTS

| | | | | |
|---|---|---|---|---|
| 4,102,513 | A | 7/1978 | Guard | |
| 4,166,589 | A | 9/1979 | Hoover | |
| 4,172,608 | A | 10/1979 | Brown, Jr. | |
| 4,235,062 | A | 11/1980 | Lancaster, III | |
| 4,255,918 | A | 3/1981 | Lancaster | |
| 4,353,515 | A | 10/1982 | Weaver | |
| 4,369,614 | A | 1/1983 | Tetzner | |
| 4,409,776 | A | 10/1983 | Usui | |
| 4,468,922 | A | 9/1984 | Mccrady | |
| 4,530,473 | A | 7/1985 | Parry | |
| 4,619,102 | A | 10/1986 | Geisinger | |
| 4,671,043 | A | 6/1987 | Forni | |
| 4,723,393 | A | 2/1988 | Silbernagel | |
| 4,739,945 | A | 4/1988 | Yokoe | |
| 4,754,594 | A | 7/1988 | Lancaster | |
| 4,807,427 | A | 2/1989 | Casteel | |
| 4,827,700 | A | 5/1989 | Rampe | |
| 4,845,920 | A | 7/1989 | Lancaster | |
| 4,905,448 | A | 3/1990 | Plitt | |
| 4,905,451 | A | 3/1990 | Jaconelli | |
| 4,961,306 | A | 10/1990 | Sawhney | |
| 5,031,771 | A | 7/1991 | Lancaster | |
| 5,079,898 | A | 1/1992 | Springs | |
| 5,107,657 | A | 4/1992 | Diehl | |
| 5,125,209 | A | 6/1992 | Thimon | |
| 5,168,685 | A | 12/1992 | Suzuki | |
| 5,195,297 | A | 3/1993 | Lancaster | |
| 5,203,939 | A | 4/1993 | Sperling | |
| 5,211,353 | A | 5/1993 | Lewin | |
| 5,307,609 | A | 5/1994 | Kurata | |
| 5,315,808 | A | 5/1994 | Macivor | |
| 5,358,594 | A | 10/1994 | Darrieux | |
| 5,385,001 | A | 1/1995 | Ramer | |
| 5,409,177 | A | 4/1995 | Parry | |
| 5,447,009 | A | 9/1995 | Oleksy | |
| 5,535,962 | A | 7/1996 | Bargowski | |
| 5,561,971 | A | 10/1996 | Sampson | |
| 5,653,293 | A | 8/1997 | Ellis | |
| 5,692,079 | A | 11/1997 | Iso | |
| 5,797,246 | A | 8/1998 | Martin-Cocher | |
| 5,819,503 | A | 10/1998 | Lancaster, III | |
| 5,878,555 | A | 3/1999 | Turfan | |
| 5,935,681 | A | 8/1999 | Paulett | |
| 5,965,262 | A | 10/1999 | Whisler | |
| 6,065,269 | A | 5/2000 | Malnati | |
| 6,102,313 | A | 8/2000 | Salzsauler | |
| 6,164,047 | A | 12/2000 | Rossi | |
| 6,311,459 | B1 | 11/2001 | Rossi | |
| 6,393,808 | B1 | 5/2002 | Kallner | |
| 6,688,076 | B1 | 2/2004 | Rivera, Jr. | |
| 6,745,544 | B2 | 6/2004 | Matsumoto | |
| 6,775,956 | B1 | 8/2004 | Lacey | |
| 6,796,105 | B2 | 9/2004 | Rossi | |
| 6,883,298 | B2 | 4/2005 | Gooding | |
| 6,892,515 | B2 | 5/2005 | Cere | |
| 6,971,220 | B1 | 12/2005 | Rampp | |
| 7,029,206 | B2 | 4/2006 | Stockstill | |
| 7,269,935 | B2 | 9/2007 | Jafari | |
| 7,581,368 | B1 | 9/2009 | Bison | |
| 7,621,107 | B2 | 11/2009 | Vanderheiden | |
| 7,908,831 | B1 | 3/2011 | Dugan | |
| 8,046,975 | B1 | 11/2011 | Bison | |
| 8,053,056 | B2 | 11/2011 | Heikaus | |
| 8,276,349 | B2 | 10/2012 | Van Amstel | |
| 8,528,615 | B2 | 9/2013 | Colson | |
| 8,549,819 | B1 * | 10/2013 | Bison | B65B 11/585 53/399 |
| 8,637,134 | B1 * | 1/2014 | Aronsen | B32B 3/08 428/137 |
| 8,707,664 | B1 | 4/2014 | Bison | |
| 8,984,848 | B2 | 3/2015 | Bison | |
| 9,254,931 | B2 | 2/2016 | Bison | |
| 9,802,722 | B1 | 10/2017 | Bison | |
| 10,279,945 | B2 | 5/2019 | Nelson | |
| 10,526,099 | B2 | 1/2020 | Bison | |
| 10,960,998 | B2 * | 3/2021 | Nicholson | B65B 11/006 |
| 11,434,029 | B1 * | 9/2022 | Bison | B65B 59/003 |
| 11,628,959 | B1 * | 4/2023 | Bison | B65B 41/16 53/399 |
| 11,912,452 | B1 | 2/2024 | Bison | |
| 11,958,642 | B1 * | 4/2024 | Bison | B65B 11/58 |
| 2004/0244336 | A1 | 12/2004 | Suolahti | |
| 2005/0123721 | A1 * | 6/2005 | Heikaus | B29C 66/1122 428/137 |
| 2006/0128245 | A1 | 6/2006 | Muth | |
| 2008/0066431 | A1 | 3/2008 | Cousins | |
| 2008/0092489 | A1 | 4/2008 | Smith | |
| 2008/0209859 | A1 | 9/2008 | Vanderheiden | |
| 2009/0178374 | A1 | 7/2009 | Lancaster, III | |
| 2009/0277136 | A1 | 11/2009 | Van Amstel | |
| 2009/0293425 | A1 | 12/2009 | Carter | |
| 2010/0018165 | A1 | 1/2010 | Kudia | |
| 2010/0300049 | A1 | 12/2010 | Schmidt | |
| 2011/0088359 | A1 * | 4/2011 | Brocard | B65B 11/585 53/461 |
| 2012/0102887 | A1 | 5/2012 | Lancaster, III | |
| 2013/0076753 | A1 | 3/2013 | Lancaster, III | |
| 2013/0104754 | A1 | 5/2013 | Van Amstel | |
| 2013/0326999 | A1 | 12/2013 | Lemieux | |
| 2014/0331609 | A1 * | 11/2014 | Bison | B65B 11/585 53/219 |
| 2015/0197355 | A1 | 7/2015 | Bison | |
| 2015/0353220 | A1 | 12/2015 | Lancaster, III | |
| 2016/0098171 | A1 | 4/2016 | Lancaster, III | |
| 2017/0101205 | A1 | 4/2017 | Schieck | |
| 2018/0208339 | A1 | 7/2018 | Bison | |
| 2018/0257799 | A1 | 9/2018 | Ragsdale | |
| 2018/0257802 | A1 | 9/2018 | Resch | |
| 2019/0084703 | A1 | 3/2019 | Nicholson | |
| 2020/0299016 | A1 | 9/2020 | Lancaster, III | |
| 2020/0377250 | A1 | 12/2020 | Lancaster, III | |
| 2023/0117677 | A1 * | 4/2023 | Bison | B65B 11/585 53/399 |
| 2023/0211908 | A1 * | 7/2023 | Bison | B65B 11/006 |
| 2024/0270418 | A1 | 8/2024 | Bison | |
| 2025/0206482 | A1 * | 6/2025 | Bison | B65B 49/12 |

FOREIGN PATENT DOCUMENTS

| | | | | |
|---|---|---|---|---|
| DE | 3933952 | C1 | 5/1990 | |
| DE | 19505240 | | 3/1996 | |
| EP | 0178145 | A1 | 4/1986 | |
| EP | 1332968 | A1 | 8/2003 | |
| EP | 1803345 | A1 | 7/2007 | |
| EP | 2589540 | A1 | 5/2013 | |
| EP | 3070003 | A1 | 9/2016 | |
| GB | 2241484 | A | 9/1991 | |
| JP | H0245309 | | 2/1990 | |
| JP | H04215903 | | 8/1992 | |
| JP | H04327108 | | 11/1992 | |
| JP | H10129609 | | 5/1998 | |
| JP | 10129609 | A | 5/1999 | |
| JP | 2000302102 | A | 10/2000 | |
| JP | 2002166905 | A | 6/2002 | |
| JP | 2002211502 | A | 7/2002 | |
| JP | 2002225806 | A | 8/2002 | |
| JP | 2002225807 | A | 8/2002 | |
| WO | 9012737 | A1 | 11/1990 | |
| WO | 2009155713 | | 12/2009 | |
| WO | WO-2023133164 | A1 * | 7/2023 | B65B 11/585 |

OTHER PUBLICATIONS

JPO machine translation of JP 10-129609 A, Aug. 14, 2013, 4 pages.
JPO machine translation of JP 2002-225806 A, Aug. 14, 2013, 15 pages.

* cited by examiner

PRE-PERFORATED STRETCH FILM WRAPPING SYSTEM AND METHOD

TECHNICAL FIELD

This document relates to a method and system for wrapping a palletized load with pre-perforated stretch film

BACKGROUND

Efficient and secure packaging of palletized loads is crucial for safeguarding goods during storage and transportation. Stretch film is commonly employed for this purpose due to its excellent ability to conform to the shape of the load and its strength in holding items together. Traditionally, stretch film is applied in a continuous, solid sheet that is manually or mechanically wrapped around the load. This process, while effective, has several limitations that can impact efficiency and effectiveness.

One major limitation of conventional stretch film is its lack of breathability. When wrapping goods, particularly those that are sensitive to moisture, the absence of ventilation can lead to condensation and spoilage. For this reason, some goods are wrapped with other materials that can provide the necessary ventilation, such as a mesh material. However, these alternative materials do not provide the same level of support to the palletized load as stretch film.

SUMMARY

Aspects of this document relate to a method of wrapping a palletized load, the method comprising providing a first spool and a second spool, wherein the first spool comprises a first roll of stretch film, a second roll of stretch film, and a third roll of stretch film, and the second spool comprises a roll of perforated stretch film with a plurality of perforations extending through the perforated stretch film at regular spacings throughout the roll, banding a top edge and a bottom edge of the stretch film from each of the first roll, the second roll, and the third roll to form, respectively, first, second, and third banded stretch films, layering the first, second, and third banded stretch films from the first spool onto the perforated stretch film from the second spool to form a layered stretch film, wherein the first banded stretch film from the first roll extends along a top edge of the perforated stretch film, the second banded stretch film from the second roll extends along a center of the perforated stretch film, and the third banded stretch film from the third roll extends along a bottom edge of the perforated stretch film, wherein the first banded stretch film from the first roll is spaced away from the second banded stretch film from the second roll to form a first gap between banded stretch films and the second banded stretch film from the second roll is spaced away from the third banded stretch film from the third roll to form a second gap between banded stretch films, expanding at least a portion of the plurality of perforations positioned in the first gap and in the second gap into a plurality of voids extending through the layered stretch film after the first, second, and third banded stretch films are layered on the perforated stretch film, and wrapping the layered stretch film around the palletized load.

Particular embodiments may comprise one or more of the following features. Expanding at least a portion of the plurality of perforations into a plurality of voids may comprise stretching the layered stretch film. The method may further comprise passing the layered stretch film through a pre-stretch machine prior to wrapping the layered stretch film around the palletized load. Each of the plurality of voids may be at least ten times larger than each of the plurality of perforations.

Aspects of this document relate to a method of wrapping a palletized load, the method comprising providing a roll of perforated stretch film with a plurality of perforations extending through the perforated stretch film at regular spacings, banding a top edge and a bottom edge of each of at least a first roll of stretch film and a second roll of stretch film to form, respectively, a first banded stretch film and a second banded stretch film, layering the first banded stretch film and the second banded stretch film onto the perforated stretch film to form layered stretch film, wherein the first banded stretch film extends along a top edge of the perforated stretch film, the second banded stretch film extends along a bottom edge of the perforated stretch film, expanding at least a portion of the plurality of perforations positioned between the first banded stretch film and the second banded stretch film into a plurality of voids extending through the layered stretch film after the first banded stretch film and the second banded stretch film are layered onto the perforated stretch film, and wrapping the layered stretch film around the palletized load.

Particular embodiments may comprise one or more of the following features. The method may further comprise passing the layered stretch film through a pre-stretch machine prior to wrapping the layered stretch film around the palletized load. Each of the plurality of perforations may have a smallest dimension of ¼ inch or less. Each of the plurality of voids may have a smallest dimension of at least one inch. Expanding at least a portion of the plurality of perforations into a plurality of voids may comprise stretching the layered stretch film. Each of the plurality of voids may be at least ten times larger than each of the plurality of perforations.

Aspects of this document relate to a method of wrapping a palletized load, the method comprising providing a roll of perforated stretch film with a plurality of perforations extending through the perforated stretch film, banding at least one of a top edge and a bottom edge of each of at least a first roll of stretch film and a second roll of stretch film to form, respectively, a first banded stretch film and a second banded stretch film, layering the first banded stretch film and the second banded stretch film onto the perforated stretch film to form layered stretch film, wherein the first banded stretch film extends along the perforated stretch film spaced away from the second banded stretch film, expanding at least a portion of the plurality of perforations positioned between the first banded stretch film and the second banded stretch film into a plurality of voids extending through the layered stretch film, and wrapping the layered stretch film around the palletized load.

Particular embodiments may comprise one or more of the following features. The method may further comprise layering the banded stretch film from the first roll along a top edge of the perforated stretch film. The method may further comprise layering the banded stretch film from the second roll along a center of the perforated stretch film. The method may further comprise banding at least one of a top edge and a bottom edge of a third roll and layering the banded stretch film from the third roll onto the perforated stretch film. The method may further comprise layering the banded stretch film from the third roll along a bottom edge of the perforated stretch film. Each of the plurality of perforations may have a smallest dimension of ¼ inch or less. Each of the plurality of voids may have a smallest dimension of at least one inch. Expanding at least a portion of the plurality of perforations into a plurality of voids may comprise stretching the layered stretch film. The method may further comprise passing the layered stretch film through a pre-stretch machine prior to wrapping the layered stretch film around the palletized load. Each of the plurality of voids may be at least ten times larger than each of the plurality of perforations.

The foregoing and other aspects, features, and advantages will be apparent from the DESCRIPTION and DRAWINGS, and from the CLAIMS if any are included.

BRIEF DESCRIPTION OF THE DRAWINGS

Implementations will hereinafter be described in conjunction with the appended and/or included DRAWINGS, where like designations denote like elements, and.

DETAILED DESCRIPTION

Figure 1:
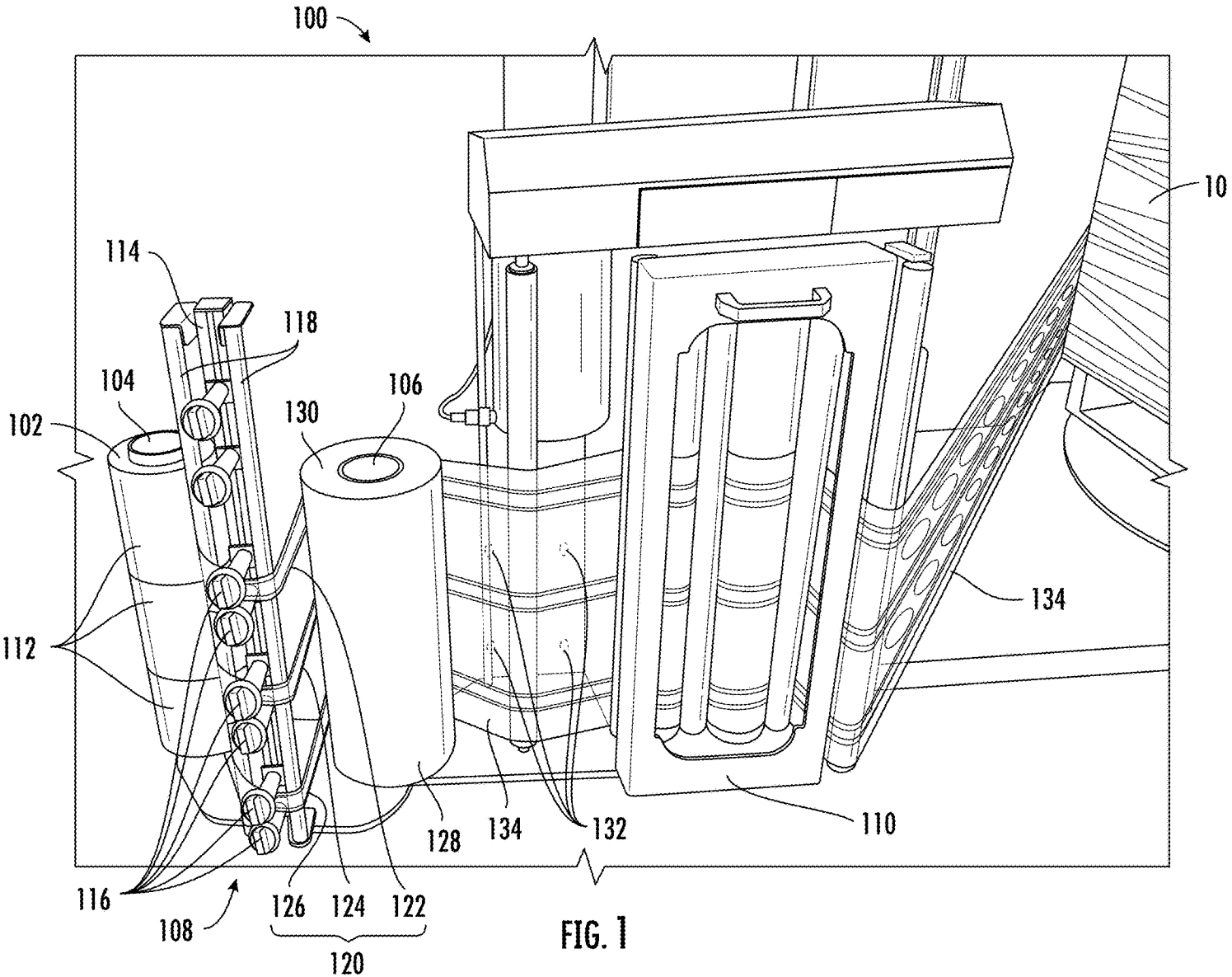
FIG. 1 is a perspective view of a perforated stretch film wrapping system according to some embodiments.

Detailed aspects and applications of the disclosure are described below in the following drawings and detailed description of the technology. Unless specifically noted, it is intended that the words and phrases in the specification and the claims be given their plain, ordinary, and accustomed meaning to those of ordinary skill in the applicable arts.

In the following description, and for the purposes of explanation, numerous specific details are set forth in order to provide a thorough understanding of the various aspects of the disclosure. It will be understood, however, by those skilled in the relevant arts, that embodiments of the technology disclosed herein may be practiced without these specific details. It should be noted that there are many different and alternative configurations, devices and technologies to which the disclosed technologies may be applied. The full scope of the technology disclosed herein is not limited to the examples that are described below.

The singular forms "a," "an," and "the" include plural referents unless the context clearly dictates otherwise. Thus, for example, reference to "a step" includes reference to one or more of such steps.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable.

Throughout the description and claims of this specification, the words "comprise" and "contain" and variations of the words, for example "comprising" and "comprises", mean "including but not limited to", and are not intended to (and do not) exclude other components.

As required, detailed embodiments of the present disclosure are included herein. It is to be understood that the disclosed embodiments are merely exemplary of the invention that may be embodied in various forms. Therefore, specific structural and functional details disclosed herein are not to be interpreted as limits, but merely as a basis for teaching one skilled in the art to employ the present invention. The specific examples below will enable the disclosure to be better understood. However, they are given merely by way of guidance and do not imply any limitation.

The present disclosure may be understood more readily by reference to the following detailed description taken in connection with the accompanying figures and examples, which form a part of this disclosure. It is to be understood that this disclosure is not limited to the specific materials, devices, methods, applications, conditions, or parameters described and/or shown herein, and that the terminology used herein is for the purpose of describing particular embodiments by way of example only and is not intended to be limiting of the claimed inventions. The term "plurality", as used herein, means more than one. When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable.

More specifically, this disclosure, its aspects and embodiments, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

As mentioned above, conventional methods of wrapping a palletized load require that the benefits of security of the load and breathability of the load be balanced, as increasing security tends to decrease breathability and vice versa. To address this issue, the present disclosure provides a pre-perforated stretch film that combines the benefits that stretch film provides with the ability of perforations to enhance air circulation and facilitate easier handling. The concept of incorporating perforations into stretch film is designed to offer a more efficient and versatile wrapping solution. By introducing pre-formed perforations, the film allows for better air flow around the palletized load, thereby reducing the risk of moisture buildup and potential damage to the wrapped goods.

The present disclosure also addresses several technical challenges that arise from perforating stretch film. These include ensuring the integrity and strength of the film despite the presence of perforations, maintaining the desired stretchability and cling properties, and effectively integrating the formation of voids for ventilation with the load-wrapping process without compromising production efficiency. The present disclosure enhances the functionality of stretch film in palletizing applications, ultimately contributing to better protection of goods and more streamlined packaging processes.

The present disclosure is related to a pallet wrapping system 100 that is configured to wrap a palletized load 10 with stretch film 102. The pallet wrapping system 100 may implement any of the features or components disclosed and discussed in detail in U.S. Pat. No. 11,958,642, issued on Apr. 16, 2024 to Darrel Bison, the entirety of the disclosure of which is hereby incorporated herein by this reference. The pallet wrapping system 100 may comprise a first spool 104, a second spool 106, a stretch film banding system 108 (as disclosed in the '642 Patent), and a pre-stretch carriage or pre-stretch machine 110.

The first spool 104 may comprise a roll 112 of stretch film 102. In some embodiments, the first spool 104 comprises multiple rolls 112 of stretch film 102, such as a first roll 112 of stretch film 102, a second roll 112 of stretch film 102, and a third roll 112 of stretch film 102. In some embodiments, the roll 112 of stretch film 102 is cut into multiple sheets of stretch film 102 as the stretch film 102 is dispensed, as disclosed in the '642 Patent. Thus, whether the first spool 104 comprises one roll 112 of stretch film 102 or multiple rolls 112 of stretch film 102, the same result can be obtained, and these alternative embodiments are considered equivalent for the purposes of this disclosure. The roll 112 of stretch film 102 is configured to rotate on the first spool 104 to dispense the stretch film 102.

Figure 2:
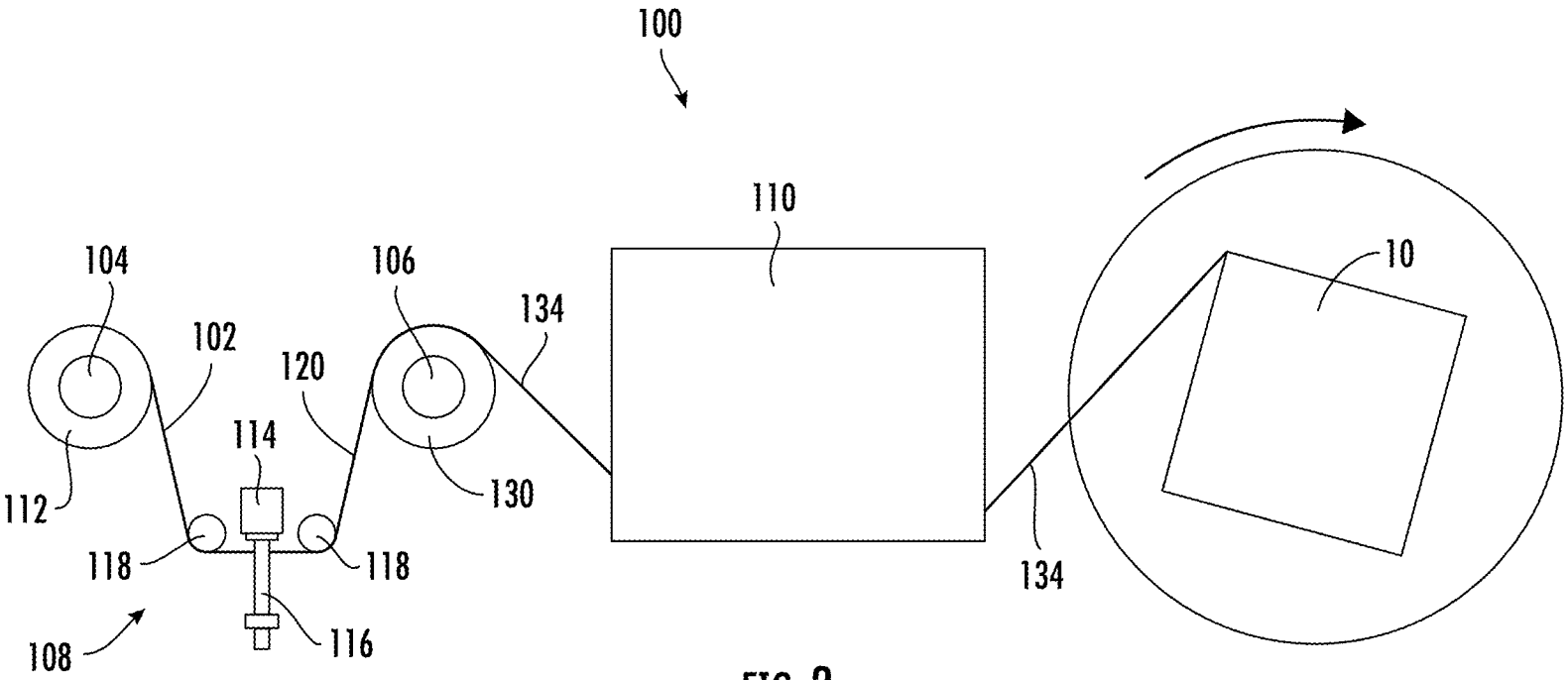
FIG. 2 is a top view of a perforated stretch film wrapping system according to some embodiments.

The first spool 104 is configured and positioned to dispense stretch film 102 into the stretch film banding system 108. The stretch film banding system 108 may comprise a support bar 114 and a plurality of adjustment arms 116 as described and shown in more detail in the '642 Patent. The adjustment arms 116 are configured to narrow the width of stretch film 102 for wrapping the palletized load 10 and band the edges of the stretch film 102 to provide additional strength to the stretch film 102. For example, as shown in FIGS. 1-2, as the stretch film 102 passes between a pair of adjustment arms 116, the adjustment arms 116 force the stretch film 102 into a smaller width because the adjustment arms 116 are closer together than the original width of the stretch film 102. This bunches or bands the edges of the stretch film 102 together to form banded stretch film 120. Depending on the number of rolls 112 of stretch film 102 on the first spool 104, the stretch film banding system 108 may be configured to create a first banded stretch film 122, a second banded stretch film 124, a third banded stretch film 126, or more. In some embodiments, the banded stretch film 120 may have a width of two inches or less. Depending on the embodiment, the top edge, the bottom edge, or both may be banded in the banded stretch film 120. The stretch film banding system 108 may also comprise guide rollers 118, also described in the '642 Patent. The guide rollers 118 are configured to guide the stretch film 102 to pass between the adjustment arms 116, and/or to guide the stretch film 102 away from the stretch film banding system 108, as shown in FIGS. 1-2.

The second spool 106 may comprise a roll 128 of perforated stretch film 130. The perforated stretch film 130 has a plurality of perforations 132 extending therethrough. The plurality of perforations 132 may each have a largest dimension of ½ inch or less. In some embodiments, each of the plurality of perforations 132 is created by a pin and has a largest dimension of 0.1 inches or less. In some embodiments, each of the plurality of perforations 132 has a smallest dimension of ¼ inch or less. In some embodiments, the second spool 106 is configured and positioned to receive the banded stretch film 120 from the stretch film banding system 108. The banded stretch film 120 may be layered directly onto the roll 128 of perforated stretch film 130, as shown in FIGS. 1-2. However, in some embodiments, rather than layering the banded stretch film 120 directly on the roll 128 of perforated stretch film 130, the perforated stretch film 130 may be dispensed from the second spool 106 and the banded stretch film 120 may be layered onto the perforated stretch film 130 on a different component, such as on a roller or inside of the pre-stretch machine 110. Layering the banded stretch film 120 onto the perforated stretch film 130 creates a layered stretch film 134. The pallet wrapping system 100 is configured to pass the layered stretch film 134 to the pre-stretch machine 110, where the layered stretch film 134 is stretched prior to application to a palletized load 10, as known in the art.

When the banded stretch film 120 is layered onto the perforated stretch film 130, multiple strips of banded stretch film 120 may be positioned as desired on the perforated stretch film 130. For example, in some embodiments, the first banded stretch film 122 extends along a top edge 136 of the perforated stretch film 130, the second banded stretch film 124 extends along a center 138 of the perforated stretch film 130, and the third banded stretch film 126 extends along a bottom edge 140 of the perforated stretch film 130. Thus, in some embodiments, the first banded stretch film 122 is spaced apart or away from the second banded stretch film 124 to form a first gap 142 between the first banded stretch film 122 and the second banded stretch film 124 on the perforated stretch film 130. Similarly, the second banded stretch film 124 and the third banded stretch film 126 may be spaced apart or away from each other to form a second gap 144 between the second banded stretch film 124 and the third banded stretch film 126.

Passing the layered stretch film 134 through the pre-stretch machine 110 stretches the layered stretch film 134 and also causes the individual components of the layered stretch film 134, such as the first banded stretch film 122, the second banded stretch film 124, the third banded stretch film 126, and the perforated stretch film 130 to be laminated together such that they become a unitary film. In this way, the banded edges of the banded stretch film 120 provide strength to the perforated stretch film 130.

Figure 3:
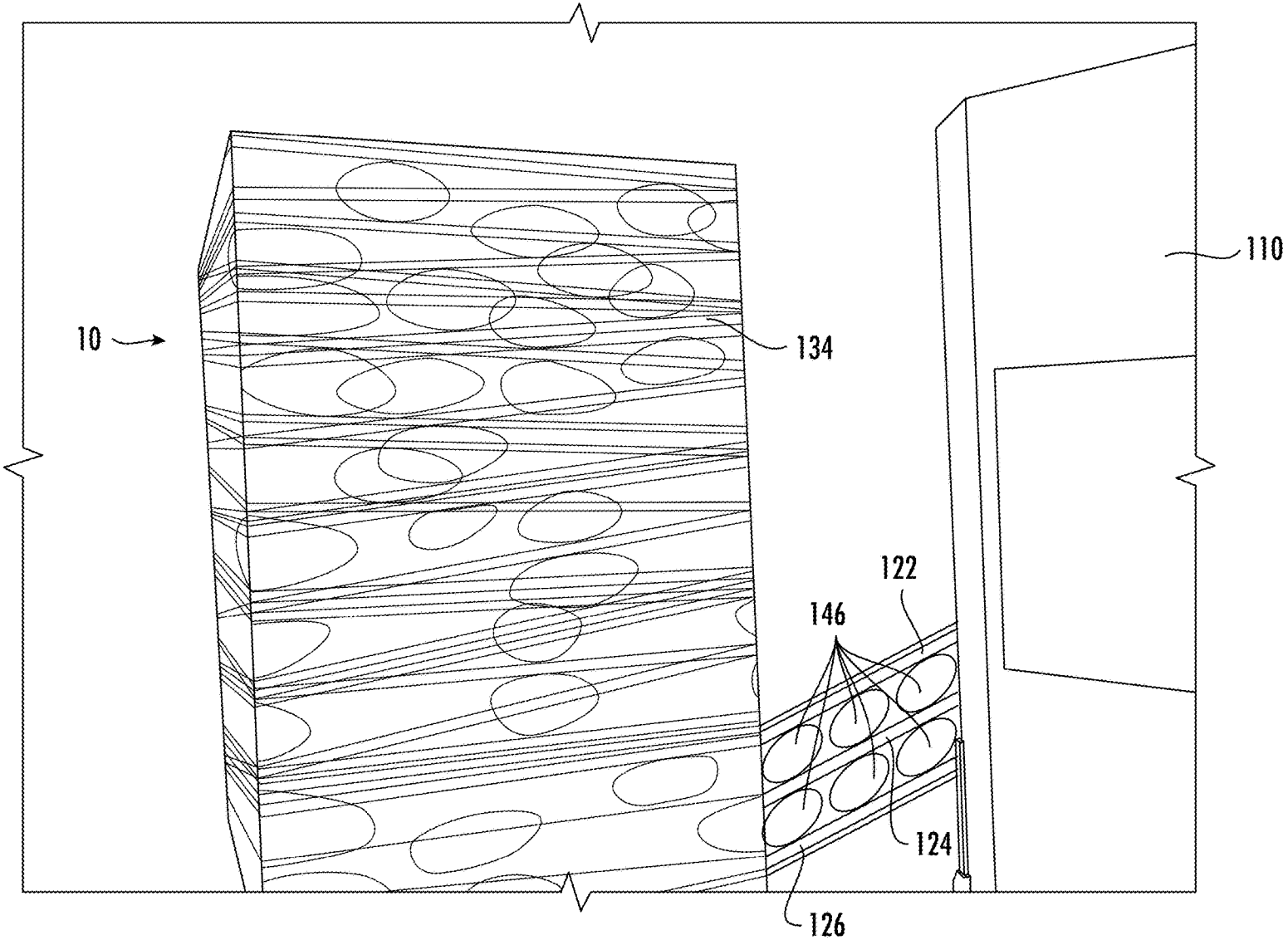
FIG. 3 is a perspective view of a palletized load wrapped with perforated stretch film according to some embodiments.
Figure 4:
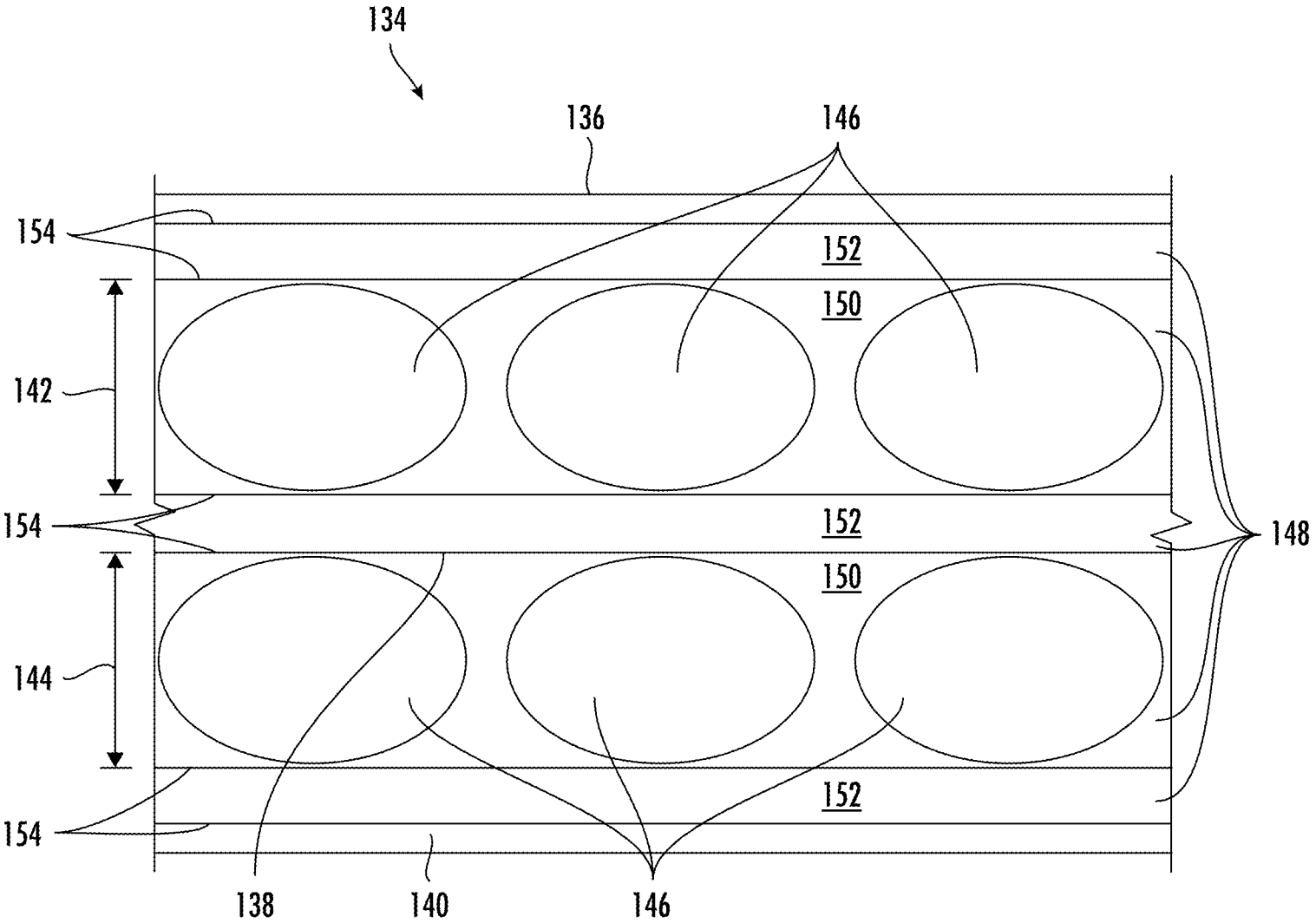
FIG. 4 is a side view of a layered, perforated stretch film according to some embodiments.

The pallet wrapping system 100 may be configured to pass the layered stretch film 134 from the pre-stretch machine 110 to a palletized load 10 to wrap the palletized load. As this occurs, the layered stretch film 134 may be further stretched. Stretching the layered stretch film 134 both in the pre-stretch machine 110 and while wrapping the palletized load 10 has a unique effect on the plurality of perforations 132 present on the perforated stretch film 130. Specifically, stretching the layered stretch film 134 causes at least a portion of the plurality of perforations 132 to expand into a plurality of voids 146, as shown in FIGS. 3-4. The plurality of voids 146 may have a smallest dimension of at least one inch. In some embodiments, each of the plurality of voids 146 has an area that is at least ten times larger than an area of each of the plurality of perforations 132. Thus, expanding the plurality of perforations 132 into the plurality of voids 146 is a substantial change to the perforated stretch film 130. If such an expansion were attempted with just the perforated stretch film 130, without layering the banded stretch film 120 on the perforated stretch film 130, the plurality of voids 146 would expand beyond the bounds of the perforated stretch film 130, tearing the perforated stretch film 130 into unusable pieces. However, with the presence of the banded stretch film 120 on the layered stretch film 134, the banded edges impede undesired expansion of the plurality of voids 146. In other words, the banded edges present on the layered stretch film 134 are configured to limit the size of the plurality of voids 146 to the desired size, thus allowing the plurality of voids 146 to fill the first gap 142 and/or the second gap 144 without compromising the integrity of the layered stretch film 134. The plurality of voids 146 are configured to provide ventilation to the palletized load 10 once the layered stretch film 134 is wrapped around the palletized load 10.

The present disclosure is also related to a method of wrapping the palletized load 10. The first spool 104 and the second spool 106 may be provided. The first spool 104 may have a first roll 112 of stretch film 102, a second roll 112 of stretch film 102, and a third roll 112 of stretch film 102. The second spool 106 may have a roll 128 of perforated stretch film 130. The top edge and/or the bottom edge of the stretch film 102 from the rolls 112 of stretch film 102 on the first spool 104 may be banded by passing the stretch film 102 through the adjustment arms 116 of the stretch film banding system 108. This may form the first banded stretch film 122, the second banded stretch film 124, and the third banded stretch film 126 described above. The banded stretch film 120 may then be layered onto the perforated stretch film 130 on the second spool 106. The first banded stretch film 122 may extend along or adjacent to the top edge 136 of the perforated stretch film 130, the second banded stretch film 124 may extend along or adjacent to the center 138 of the perforated stretch film 130, and the third banded stretch film 126 may extend along or adjacent to the bottom edge 140. Any of the first banded stretch film 122, the second banded stretch film 124, and the third banded stretch film 126 may be excluded in a particular embodiment. At least a portion of the plurality of perforations 132 may be expanded within the first gap 142 and/or the second gap 144 into the plurality of voids 146 as described above. Expanding the plurality of perforations 132 into the plurality of voids 146 may occur after the banded stretch film 120 has been layered onto the perforated stretch film 130. The layered stretch film 134 may then be wrapped around the palletized load 10.

The layered stretch film 134 may comprise a plurality of sections 148, as illustrated in FIG. 4. The sections 148 may alternate between one-layer sections 150 with one layer of stretch film and two-layer sections 152 with two layers of stretch film. Each of the sections 148 may be separated by a banded border 154. The one-layer sections 150 of stretch film may contain the plurality of voids 146, and the banded borders 154 may act to prevent the plurality of voids 146 from expanding beyond the one-layer sections 150 of stretch film, as discussed above. This enables the creation of the plurality of voids 146 without tearing the layered stretch film 134 or otherwise compromising the integrity of the layered stretch film 134.

The presently disclosed pallet wrapping system 100 and method of wrapping a palletized load 10 are effective in providing security of the load 10 and breathability to the load 10. The perforated stretch film 130 combines the benefits that stretch film provides with the ability of perforations to enhance air circulation and facilitate easier handling. Thus, the present disclosure offers a more efficient and versatile wrapping solution to conventional systems and methods. By introducing pre-formed perforations, the film allows for better air flow around the palletized load, thereby reducing the risk of moisture buildup and potential damage to the wrapped goods. This is done while ensuring the integrity and strength of the film despite the presence of perforations, maintaining the desired stretchability and cling properties, and effectively integrating the formation of voids for ventilation with the load-wrapping process without compromising production efficiency. The present disclosure thus enhances the functionality of stretch film in palletizing applications, ultimately contributing to better protection of goods and more streamlined packaging processes.

Many additional implementations are possible. Further implementations are within the CLAIMS.

It will be understood that implementations of the perforated stretch film include but are not limited to the specific components disclosed herein, as virtually any components consistent with the intended operation of various perforated stretch films may be utilized. Accordingly, for example, it should be understood that, while the drawings and accompanying text show and describe particular perforated stretch film implementations, any such implementation may comprise any shape, size, style, type, model, version, class, grade, measurement, concentration, material, weight, quantity, and/or the like consistent with the intended operation of perforated stretch film.

The concepts disclosed herein are not limited to the specific perforated stretch film shown herein. For example, it is specifically contemplated that the components included in particular perforated stretch films may be formed of any of many different types of materials or combinations that can readily be formed into shaped objects and that are consistent with the intended operation of the perforated stretch film. For example, the components may be formed of: rubbers (synthetic and/or natural) and/or other like materials; glasses (such as fiberglass), carbon-fiber, aramid-fiber, any combination therefore, and/or other like materials; elastomers and/or other like materials; polymers such as thermoplastics (such as ABS, fluoropolymers, polyacetal, polyamide, polycarbonate, polyethylene, polysulfone, and/or the like, thermosets (such as epoxy, phenolic resin, polyimide, polyurethane, and/or the like), and/or other like materials; plastics and/or other like materials; composites and/or other like materials; metals, such as zinc, magnesium, titanium, copper, iron, steel, carbon steel, alloy steel, tool steel, stainless steel, spring steel, aluminum, and/or other like materials; and/or any combination of the foregoing.

Furthermore, perforated stretch film may be manufactured separately and then assembled together, or any or all of the components may be manufactured simultaneously and integrally joined with one another. Manufacture of these components separately or simultaneously, as understood by those of ordinary skill in the art, may involve 3-D printing, extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components.

In places where the description above refers to particular perforated stretch film implementations, it should be readily apparent that a number of modifications may be made without departing from the spirit thereof and that these implementations may be applied to other implementations disclosed or undisclosed. The presently disclosed perforated stretch film is, therefore, to be considered in all respects as illustrative and not restrictive.

We claim:

1. A method of wrapping a palletized load, the method comprising:

providing a first spool and a second spool, wherein the first spool comprises a first roll of stretch film, a second roll of stretch film, and a third roll of stretch film, and the second spool comprises a roll of perforated stretch film with a plurality of perforations extending through the perforated stretch film at regular spacings throughout the roll;

banding a top edge and a bottom edge of the stretch film from each of the first roll, the second roll, and the third roll to form, respectively, first, second, and third banded stretch films;

layering the first, second, and third banded stretch films from the first spool onto the perforated stretch film from the second spool to form a layered stretch film, wherein the first banded stretch film from the first roll extends along a top edge of the perforated stretch film, the second banded stretch film from the second roll extends along a center of the perforated stretch film, and the third banded stretch film from the third roll extends along a bottom edge of the perforated stretch film, wherein the first banded stretch film from the first roll is spaced away from the second banded stretch film from the second roll to form a first gap between the first and second banded stretch films and the second banded stretch film from the second roll is spaced away from the third banded stretch film from the third roll to form a second gap between the second and third banded stretch films;

expanding at least a portion of the plurality of perforations positioned in the first gap and in the second gap into a plurality of voids extending through the layered stretch film after the first, second, and third banded stretch films are layered on the perforated stretch film; and wrapping the layered stretch film around the palletized load.

2. The method of claim 1, wherein expanding at least a portion of the plurality of perforations into the plurality of voids comprises stretching the layered stretch film.

3. The method of claim 1, further comprising passing the layered stretch film through a pre-stretch machine prior to wrapping the layered stretch film around the palletized load.

4. The method of claim 1, wherein each of the plurality of voids is at least ten times larger than each of the plurality of perforations.

5. A method of wrapping a palletized load, the method comprising:

providing a roll of perforated stretch film with a plurality of perforations extending through the perforated stretch film at regular spacings;

banding a top edge and a bottom edge of each of at least a first roll of stretch film and a second roll of stretch film to form, respectively, a first banded stretch film and a second banded stretch film;

layering the first banded stretch film and the second banded stretch film onto the perforated stretch film to form a layered stretch film, wherein the first banded stretch film extends along a top edge of the perforated stretch film, the second banded stretch film extends along a bottom edge of the perforated stretch film;

expanding at least a portion of the plurality of perforations positioned between the first banded stretch film and the second banded stretch film into a plurality of voids extending through the layered stretch film after the first banded stretch film and the second banded stretch film are layered onto the perforated stretch film; and wrapping the layered stretch film around the palletized load.

6. The method of claim 5, further comprising passing the layered stretch film through a pre-stretch machine prior to wrapping the layered stretch film around the palletized load.

7. The method of claim 5, wherein each of the plurality of perforations has a smallest dimension of ¼ inch or less.

8. The method of claim 5, wherein each of the plurality of voids has a dimension of at least one inch.

9. The method of claim 5, wherein expanding at least a portion of the plurality of perforations into a plurality of voids comprises stretching the layered stretch film.

10. The method of claim 5, wherein each of the plurality of voids is at least ten times larger than each of the plurality of perforations.

11. A method of wrapping a palletized load, the method comprising:

providing a roll of perforated stretch film with a plurality of perforations extending through the perforated stretch film;

banding at least one of a top edge and a bottom edge of each of at least a first roll of stretch film and a second roll of stretch film to form, respectively, a first banded stretch film and a second banded stretch film;

layering the first banded stretch film and the second banded stretch film onto the perforated stretch film to form a layered stretch film, wherein the first banded stretch film extends along the perforated stretch film spaced away from the second banded stretch film;

expanding at least a portion of the plurality of perforations positioned between the first banded stretch film and the second banded stretch film into a plurality of voids extending through the layered stretch film; and wrapping the layered stretch film around the palletized load.

12. The method of claim 11, further comprising layering the banded stretch film from the first roll along a top edge of the perforated stretch film.

13. The method of claim 11, further comprising layering the banded stretch film from the second roll along a center of the perforated stretch film.

14. The method of claim 11, further comprising banding at least one of a top edge and a bottom edge of a third roll and layering the banded stretch film from the third roll onto the perforated stretch film.

15. The method of claim 14, further comprising layering the banded stretch film from the third roll along a bottom edge of the perforated stretch film.

16. The method of claim 11, wherein each of the plurality of perforations has a smallest dimension of ¼ inch or less.

17. The method of claim 16, wherein each of the plurality of voids has a smallest dimension of at least one inch.

18. The method of claim 11, wherein expanding at least a portion of the plurality of perforations into a plurality of voids comprises stretching the layered stretch film.

19. The method of claim 11, further comprising passing the layered stretch film through a pre-stretch machine prior to wrapping the layered stretch film around the palletized load.

20. The method of claim 11, wherein each of the plurality of voids is at least ten times larger than each of the plurality of perforations.

* * * * *